United States Patent [19]

Carroll

[11] 4,061,434

[45] Dec. 6, 1977

[54] REINFORCED CONCRETE CATCH BASIN COVER AND LID

[76] Inventor: Glenn T. Carroll, 1850 Price Road, Youngstown, Ohio 44509

[21] Appl. No.: 779,608

[22] Filed: Mar. 21, 1977

[51] Int. Cl.[2] ..... F16D 1/00; F16L 25/00

[52] U.S. Cl. ..... 404/4; 52/21

[58] Field of Search ..... 404/2, 3, 4, 5; 54/19, 54/20, 21

[56] References Cited

U.S. PATENT DOCUMENTS

| | | | |
|---|---|---|---|
| 868,672 | 10/1907 | Kurz | 404/4 |
| 1,035,722 | 8/1912 | Mugler et al. | 54/21 |
| 3,263,376 | 8/1966 | Dorris | 54/20 |

*Primary Examiner*—Henry S. Jaudon
*Attorney, Agent, or Firm*—Webster B. Harpman

[57] ABSTRACT

A catch basin cover and lid takes the form of a reinforced concrete slab-like body of a desirable shape and provided with a central opening and a lid and replaces the cast iron catch basin covers heretofore generally employed. The reinforcing members are shaped to support the peripheral edges of the concrete slab and are positioned transversely therein so as to engage and support a reinforcing ring defining the access opening in the cover, the reinforced concrete catch basin cover and lid are uniformally sized by formation of the same in an appropriately shaped outline mold uniformly spaced with respect to the reinforcing members of the catch basin cover.

4 Claims, 4 Drawing Figures

REINFORCED CONCRETE CATCH BASIN COVER AND LID

BACKGROUND OF THE INVENTION

1. Field of the Invention

This invention relates to catch basin covers of the type normally employed to form a closure at the ground level with respect to a catch basin as used in providing drainage for streets, roadways and the like.

2. Description of the Prior Art

Prior structures of this type may be seen in U.S. Pat. No. 760,841, 881,003 and 2,537,654. In U.S. Pat. No. 881,003 the artifical stone sewer cap comprises a relatively thick square body member with a central opening and transversely positioning reinforcing bars. There are no reinforcing members approximately defining the finished shape of the cover as in the case of present invention.

In U.S. Pat. No. 760,841 a substantially square artificial stone sewer cap is disclosed and the reinforcement is confined to a slotted member positioned adjacent one edge thereof. There is no comparable reinforcing structure having the approximate shape of the finished cover.

In U.S. Pat. No. 2,537,654 a few transversely extending reinforcing bars are employed. There are no reinforcing members defining a shape substantially similar to and comparable in outline with the catch basin cover of the present invention.

This invention provides a simple and inexpensively formed catch basin cover and cap which may be quickly and easily made by relatively unskilled labor utilizing matching outline forms and appropriately shaped reinforcing structures cooperating to form a desirable reinforced concrete catch basin cover.

SUMMARY OF THE INVENTION

A reinforced concrete catch basin cover and lid comprise a novel structure in which a reinforcing member of substantially the same outline as the finished reinforced concrete catch basin cover is employed in conjunction with a mold or form in which the concrete is cast after the reinforcing member is disposed therein. The resulting reinforced concrete catch basin cover has reinforcing members uniformly spaced inwardly of its peripheral edges and transversely and longitudinally thereof in crisscross relation and are joined to and support a circular reinforcing member which defines the opening in the cover in which a reinforced concrete lid is finally positioned.

DESCRIPTION OF THE PREFERRED EMBODIMENT

Figure 1:
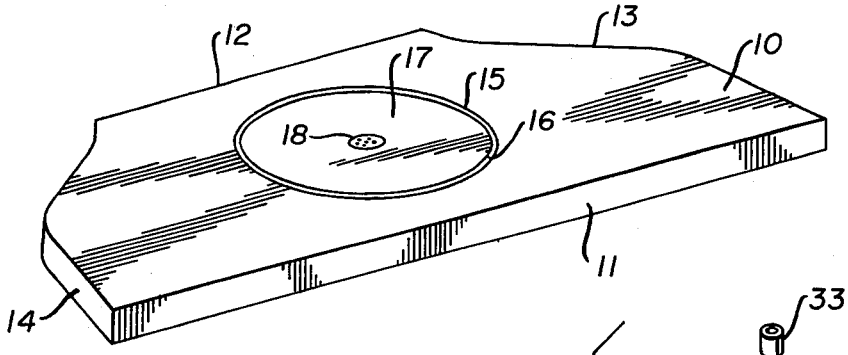
FIG. 1 is a perspective view of the reinforced concrete catch basin cover and lid.

By referring to the drawings and FIG. 1 in particular it will be seen that a reinforced concrete catch basin cover and lid are disclosed, the cover comprising a slab-like body 10 having a straight longitudinal front edge 11, a shorter parallel straight rear edge 12 and composite straight and curved oppositely disposed right and left side edges 13 and 14 respectively.

Figure 3:
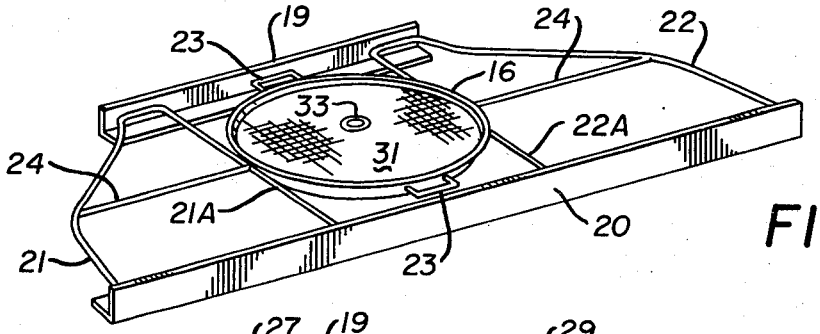
FIG. 3 is a perspective view of the reinforcing member incorporating the reinforcing ring of FIG. 2.

A circular opening 15 is located in the center of the slab-like body 10 and is defined by a metal ring 16 and is normally closed by a reinforced concrete lid 17 having a central aperture 18 therein. The reinforced concrete catch basin cover and lid as seen in FIG. 1 in its finished form is produced by positioning a reinforcing member as seen in FIG. 3 of the drawings, which member is formed of spaced, parallel angle irons 19 and 20 and interconnecting appropriately shaped reinforcing bars 21 and 22 which form both the oppositely disposed ends of the reinforcing member as well as front to back reinforcing bars 21A and 22A. The reinforcing ring 16 heretofore referred to is secured to the bars 21A and 22A as by welding and the ends of the reinforcing bars 21, 21A, 22 and 22A are secured as by welding to the angle irons 19 and 20 so that the reinforcing member are seen in FIG. 3 of the drawings comprises a structure which has an outline and shape similar to the finished reinforced concrete catch basin cover as seen in FIG. 1 of the drawings. In FIG. 3 of the drawings the reinforcing ring 16 is illustrated as provided with U-shaped extensions 23 on its opposite edges which are also secured as by welding to the angle irons 19 and 20. A pair of transversely extending reinforcing bars 24 are positioned are one on either side of the reinforcing ring 16 and welded thereto. The bars 24 extend outwardly and are welded at their point of contact with the reinforcing bars 21 and 22 heretofore described.

Figure 4:
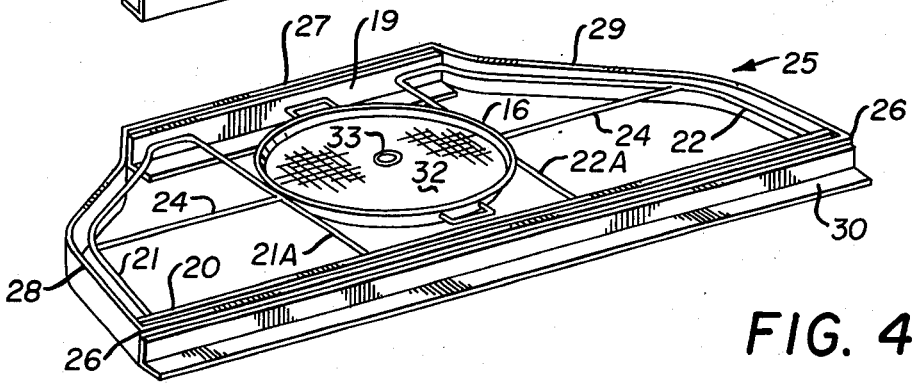
FIG. 4 is a perspective view of the reinforcing member of FIG. 3 disposed in a mold of a comparable outline in which the concrete is cast.

By referring now to FIG. 4 of the drawings it will be seen that a mold defining the shape of the finished reinforced concrete catch basin cover seen in FIG. 1 is diclosed and it is generally indicated by the numeral 25. It comprises front and back parallel vertically standing wall members 26 and 27 respectively and oppositely disposed end members 28 and 29 respectively, the end members being shaped in accordance with the ends 13 and 14 of the finished catch basin cover. The front vertically standing wall member 26 is provided with a reinforcing angle iron 30 and in FIG. 4 of the drawings, the reinforcing member of FIG. 3 of the drawings is shown positioned in the mold 25 and it will be observed that the several parts thereof are spaced with respect to the vertically standing wall members of the mold.

Figure 2:
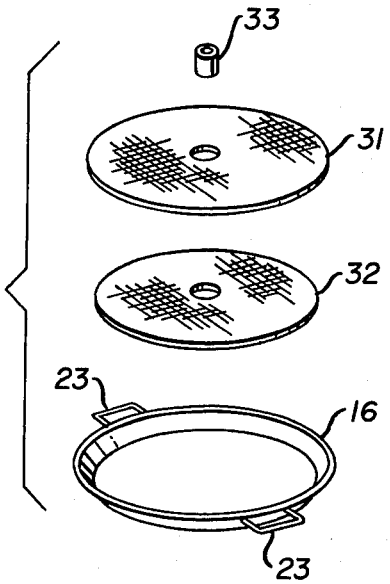
FIG. 2 is an exploded view of the reinforcing members used in the lid together with the reinforcing opening defining ring used in the cover.

Properly mixed cement of a desirable consistency poured into the mold 25 over and around the reinforcing member therein will form the finished reinforced concrete catch basin cover as seen in FIG. 1 of the drawings. In order to provide the lid 17 as seen in FIG. 1 of the drawings, one or two round shaped sections of reinforcing mesh 31 and 32 are used and they are spaced by a cylindrical fitting 33. They are best illustrated in FIG. 2 of the drawings and it will be observed by referring thereto that when spaced by the cylindrical member 33 they can be positioned in the ring 16 heretofore referred to which is part of the reinforcing member of FIG. 3 so that it becomes a mold for the concrete poured therein and around and about the round shaped sections of flat reinforcing mesh 31 and 32. The finished lid is as illustrated and heretofore described in connection with FIG. 1 of the drawings.

It will thus be seen that a reinforced concrete catch basin cover and lid have been disclosed which may be quickly and inexpensively formed through the use of the mold 25 and the reinforcing member which corresponds generally in size and shape therewith. The finished catch basin cover has the unique properties of unusual strength and relatively lightweight configuration as compared with the precast or molded concrete covers or the like of the prior art.

Although but one embodiment of the present invention has been illustrated and described, it will be apparent to those skilled in the art that various changes and modifications may be made therein without departing from the spirit of the invention and having thus described may invention what I claim is:

1. A reinforced concrete catch basin cover and lid comprising a reinforcing member having spaced parallel front and back angle iron sections, interconnecting members secured thereto and a ring member disposed centrally thereof, said front and back sections and the outermost ones of said interconnecting members defining a shape substantially the same as that of the concrete catch basin cover and a cast concrete body enveloping said reinforcing sections and members, said ring defining an opening in said cover.

2. The reinforced concrete catch basin cover set forth in claim 1 and wherein said ring is formed of an annular section of metal strip arranged in a frustoconical shape opening upwardly and outwardly.

3. The reinforced concrete catch basin cover set forth in claim 1 and wherein said front and back sections of said reinforcing member and arranged with their horizontal flanges inturned.

4. The reinforced concrete catch basin cover set forth in claim 1 and wherein said interconnecting members of said reinforcing member are reinforcing bars.

* * * * *